US011441307B2

(12) United States Patent
Huang

(10) Patent No.: US 11,441,307 B2
(45) Date of Patent: Sep. 13, 2022

(54) PRECAST BUILDING MATERIAL

(71) Applicant: Yung-Chia Huang, Nantou (TW)

(72) Inventor: Yung-Chia Huang, Nantou (TW)

( * ) Notice: Subject to any disclaimer, the term of this patent is extended or adjusted under 35 U.S.C. 154(b) by 131 days.

(21) Appl. No.: 16/880,097

(22) Filed: May 21, 2020

(65) Prior Publication Data

US 2021/0032854 A1 Feb. 4, 2021

(30) Foreign Application Priority Data

Aug. 2, 2019 (CN) ..... 201910712307.7

(51) Int. Cl.
*E04B 1/04* (2006.01)
*E04B 1/24* (2006.01)
*E04B 1/19* (2006.01)

(52) U.S. Cl.
CPC ..... *E04B 1/043* (2013.01); *E04B 1/2403* (2013.01); *E04B 2001/1975* (2013.01)

(58) Field of Classification Search
CPC ..... E04B 1/043; E04B 1/2403; E04B 2001/1975; E04B 1/34321; E04B 2001/6195; E04C 2/384; E04C 2/26; E04C 2/38
USPC ..... 52/79.9–79.14, 309.16–309.17
See application file for complete search history.

(56) References Cited

U.S. PATENT DOCUMENTS 3,760,540 A * 9/1973 Latoria ..... E04C 2/384 52/125.5
4,320,606 A * 3/1982 GangaRao ..... E04C 2/521 52/600
4,970,838 A * 11/1990 Phillips ..... E04B 1/04 52/250
5,248,122 A * 9/1993 Graham ..... E04C 2/521 249/91
6,202,375 B1 * 3/2001 Kleinschmidt ..... E04C 2/288 52/309.7
6,443,666 B1 * 9/2002 Smith ..... E02B 3/102 52/223.6
6,898,908 B2 * 5/2005 Messenger ..... E04C 2/06 52/406.1
8,567,153 B1 * 10/2013 Francavilla ..... E04C 2/384 52/309.4

(Continued)

*Primary Examiner* — Brian E Glessner
*Assistant Examiner* — Adam G Barlow
(74) *Attorney, Agent, or Firm* — Alan D. Kamrath; Karin L. Williams; Mayer & Williams PC

(57) ABSTRACT

A precast building material contains a substrate, a peripheral frame, a metal reinforcement unit, and a concrete layer. The substrate is in a parallelogram shape. The peripheral frame is mounted around the substrate so that an accommodation chamber is defined between the peripheral frame and the substrate. The peripheral frame includes multiple first connection rails having at least one first slot, multiple second connection rails having at least one second slot, multiple first engagement portions, and multiple second engagement portions. The respective first connection rail has multiple first locking orifices, and the respective second connection rail has multiple second locking orifices. The metal reinforcement unit is fixed in the accommodation chamber and includes multiple rebars. The concrete layer paving the accommodation chamber, and the concrete layer is connected with the peripheral frame and the metal reinforcement unit and is removable from the substrate.

4 Claims, 16 Drawing Sheets

(56) References Cited

U.S. PATENT DOCUMENTS

| | | | | |
|---|---|---|---|---|
| 9,114,549 | B2 * | 8/2015 | Ciuperca | E01C 9/001 |
| 9,181,699 | B2 * | 11/2015 | Ciuperca | E04F 13/077 |
| 9,862,118 | B2 * | 1/2018 | Ciuperca | B28B 17/0081 |
| 9,955,528 | B2 * | 4/2018 | Ciuperca | B28B 7/42 |
| 10,221,581 | B2 * | 3/2019 | Phillips | E04B 5/43 |
| 11,105,084 | B1 * | 8/2021 | Cui | E04C 3/293 |
| 2011/0185664 | A1 * | 8/2011 | Lee | E04C 2/288 52/309.16 |
| 2012/0174518 | A1 * | 7/2012 | Litaize | E04C 2/26 52/582.1 |
| 2014/0260034 | A1 * | 9/2014 | Ciuperca | E04C 5/125 52/405.3 |
| 2017/0218644 | A1 * | 8/2017 | Ciuperca | E04B 1/21 |
| 2021/0301528 | A1 * | 9/2021 | Dombowsky | E04B 1/14 |

* cited by examiner

PRECAST BUILDING MATERIAL

BACKGROUND OF THE INVENTION

Field of the Invention

The present invention relates to a precast building material which is applicable for construction.

Description of the Prior Art

A conventional building is built from reinforced concrete to achieve reinforcement and fire resistance. However, it is required to provide foundation and beams, erect steel bars, set ganged forms and have grouting, thus causing building inconvenience and difficulty, high construction cost, and long building time.

To overcome above-mentioned problems, a modular house has been developed in three types as follows:

1. The modular house is made of wood materials to obtain thermal insulation, sound absorption, moisture absorption, and natural environmental protection in a green technology. But the wood materials have to be shipped to a construction site and are cut, connected, and nailed, thus having troublesome assembly, fragile disassembly, no recycling, poor reinforcement, security and fire resistance, short service life, and danger.

2. When the modular house is a container house, it is easy to construct and connect with the other containers. Yet, it is easy to cause corrosion and rust, so coating anti-rust paints is required. Moreover, the container house has poor appearance and air circulation.

3. When the modular house is a metal-sheet house, it is built quickly. Nevertheless, it is broken easily because of typhoon, wind, and heavy rain. In addition, the metal-sheet house absorbs heat easily and dissipates heat slowly to cause a high temperature. Also, the metal-sheet house is rusty and to discolor the coating paint easily, thus repeatedly coating paint is inevitable.

The present invention has arisen to mitigate and/or obviate the afore-described disadvantages.

SUMMARY OF THE INVENTION

The primary objective of the present invention is to provide a precast building material which is pre-casting formed in a factory and is moved to a construction site so as to build a house easily at a low construction cost, thus accelerating construction time, applying for various houses, and recycling the precast building material.

Another objective of the present invention is to provide a precast building material which reinforces the house and facilitates security, fire and heat resistance, noise isolation, and seismic performance.

To achieve above-mentioned objectives, a precast building material provided by the present invention contains: a substrate, a peripheral frame, a metal reinforcement unit, and a concrete layer.

The substrate is formed in a parallelogram shape and is detachable.

The peripheral frame is mounted around a peripheral side of the substrate so that an accommodation chamber is defined between the peripheral frame and the substrate. The peripheral frame includes multiple first connection rails, and a respective first connection rail has at least one first slot defined thereon. At least two sides of the peripheral frame are screwed with multiple second connection rails, and a respective second rail has at least one second slot defined thereon, the peripheral frame includes multiple convex engagement portions fixed on the at least two sides thereof and multiple concave engagement portions. A respective concave engagement portion mates with a respective convex engagement portion, the respective first connection rail has multiple first locking orifices defined thereon, and the respective second connection rail has multiple second locking orifices formed thereon.

The metal reinforcement unit is accommodated in the accommodation chamber and is welded with an inner wall of the accommodation chamber, the metal reinforcement unit includes multiple rebars, and the multiple rebars are intersected with one another.

The concrete layer is filled with the accommodation chamber to cover the metal reinforcement unit, such that the concrete layer is connected with the peripheral frame and the metal reinforcement unit and is removable from the substrate.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
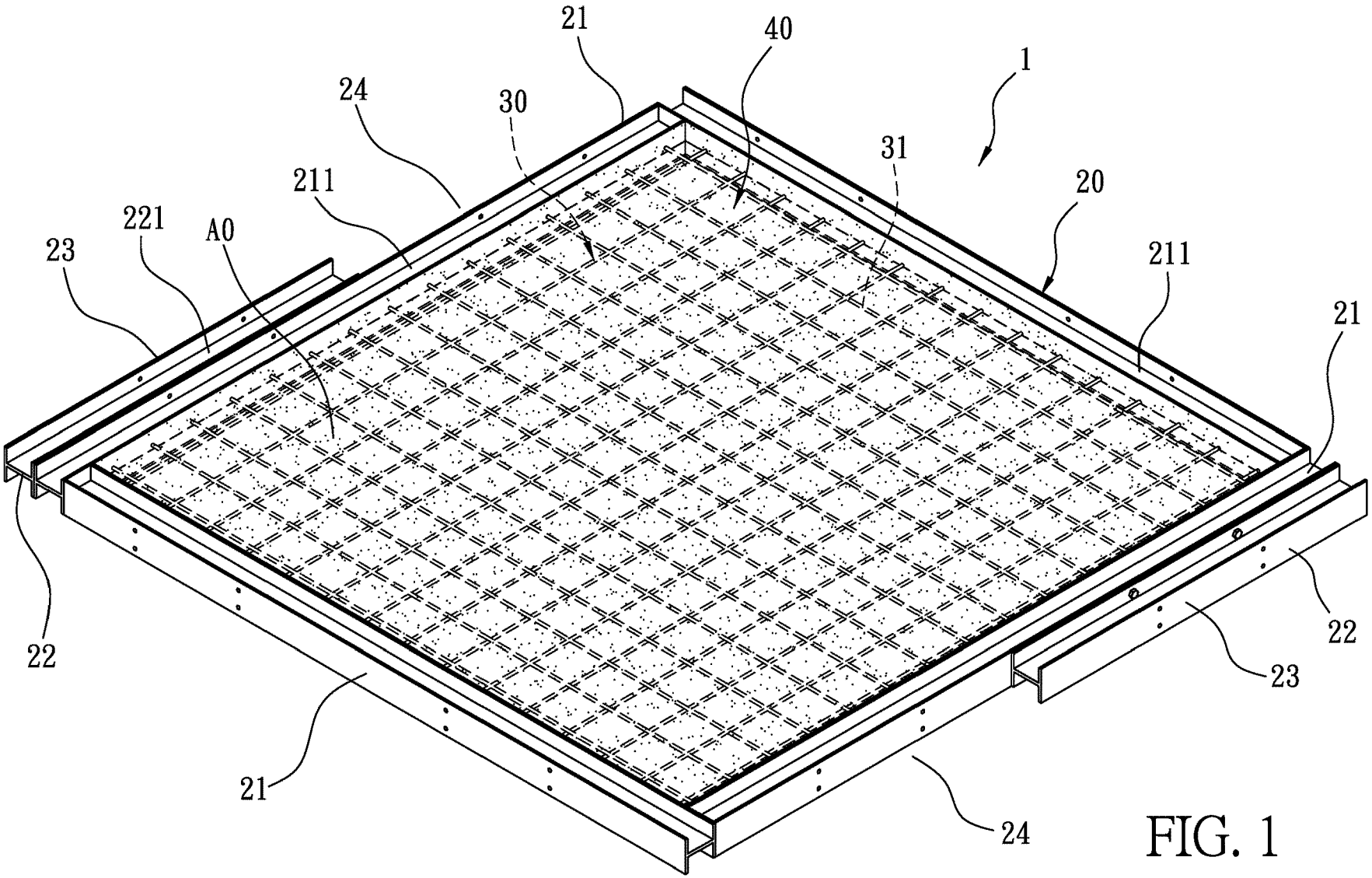
FIG. 1 is a perspective view showing the assembly of a precast building material according to a preferred embodiment of the present invention.
Figure 2:
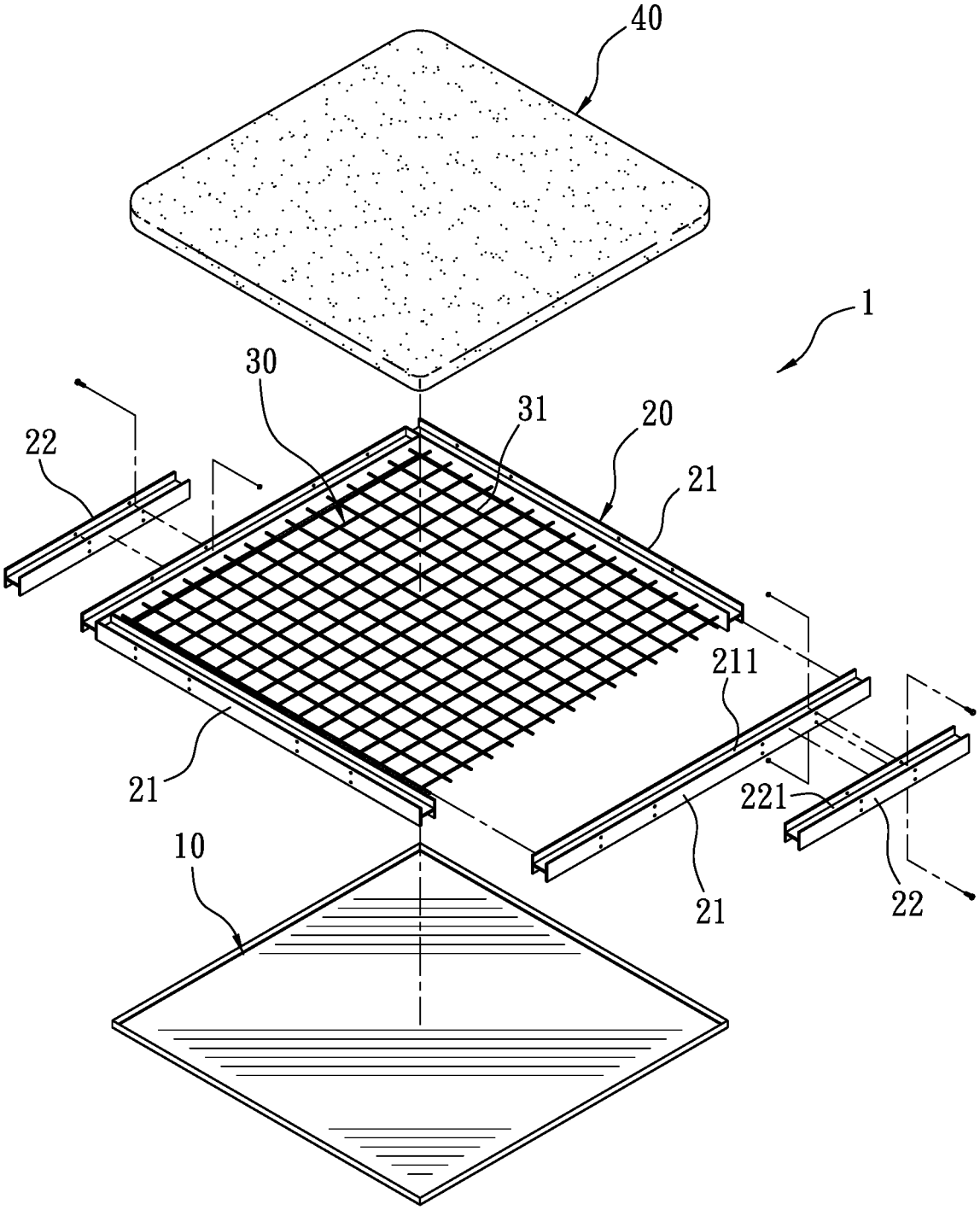
FIG. 2 is a perspective view showing the exploded components of the precast building material according to the preferred embodiment of the present invention.
Figure 3:
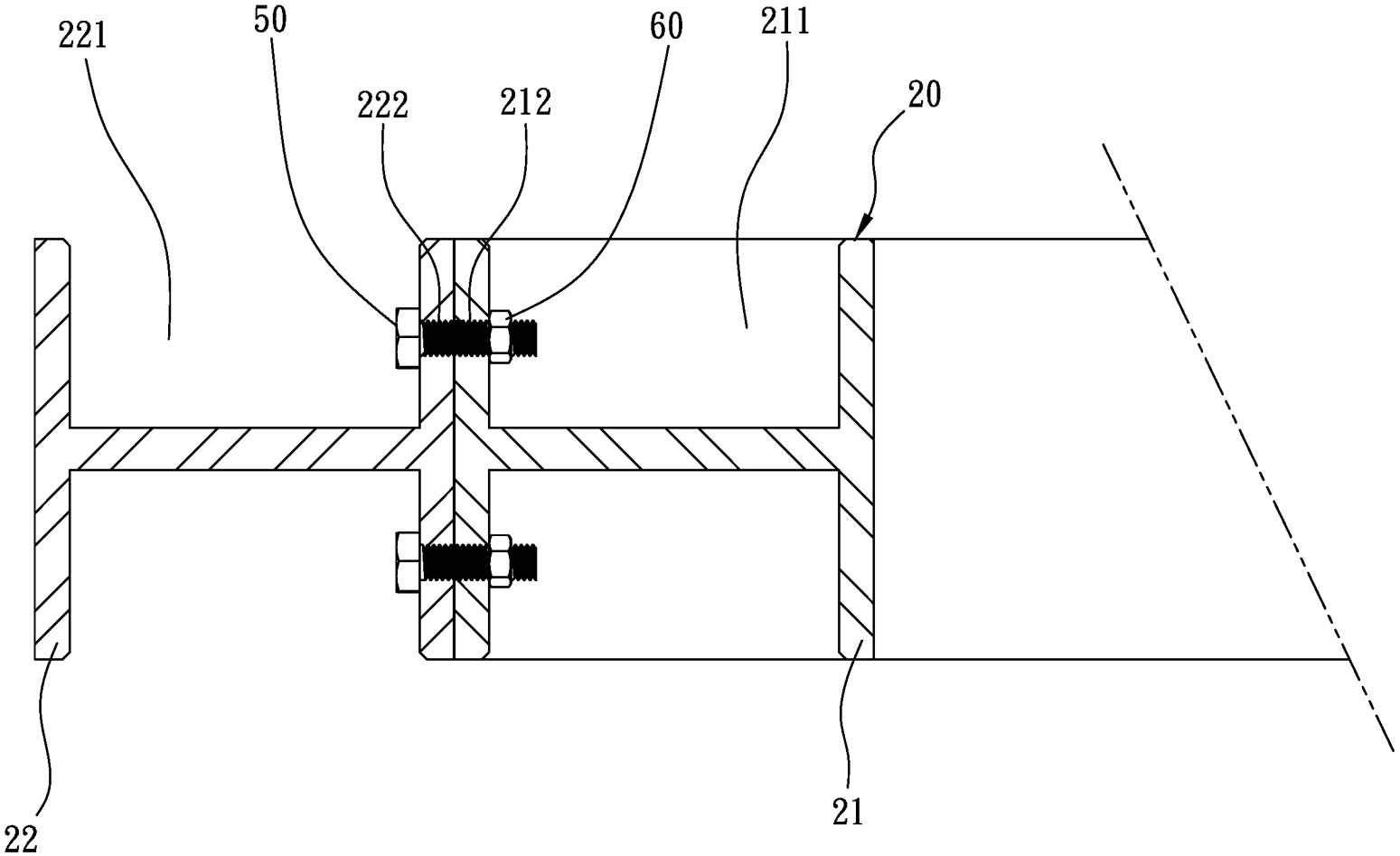
FIG. 3 is a cross-sectional view showing the assembly of a first connection rail and a second connection rail of the precast building material according to the preferred embodiment of the present invention.
Figure 4:
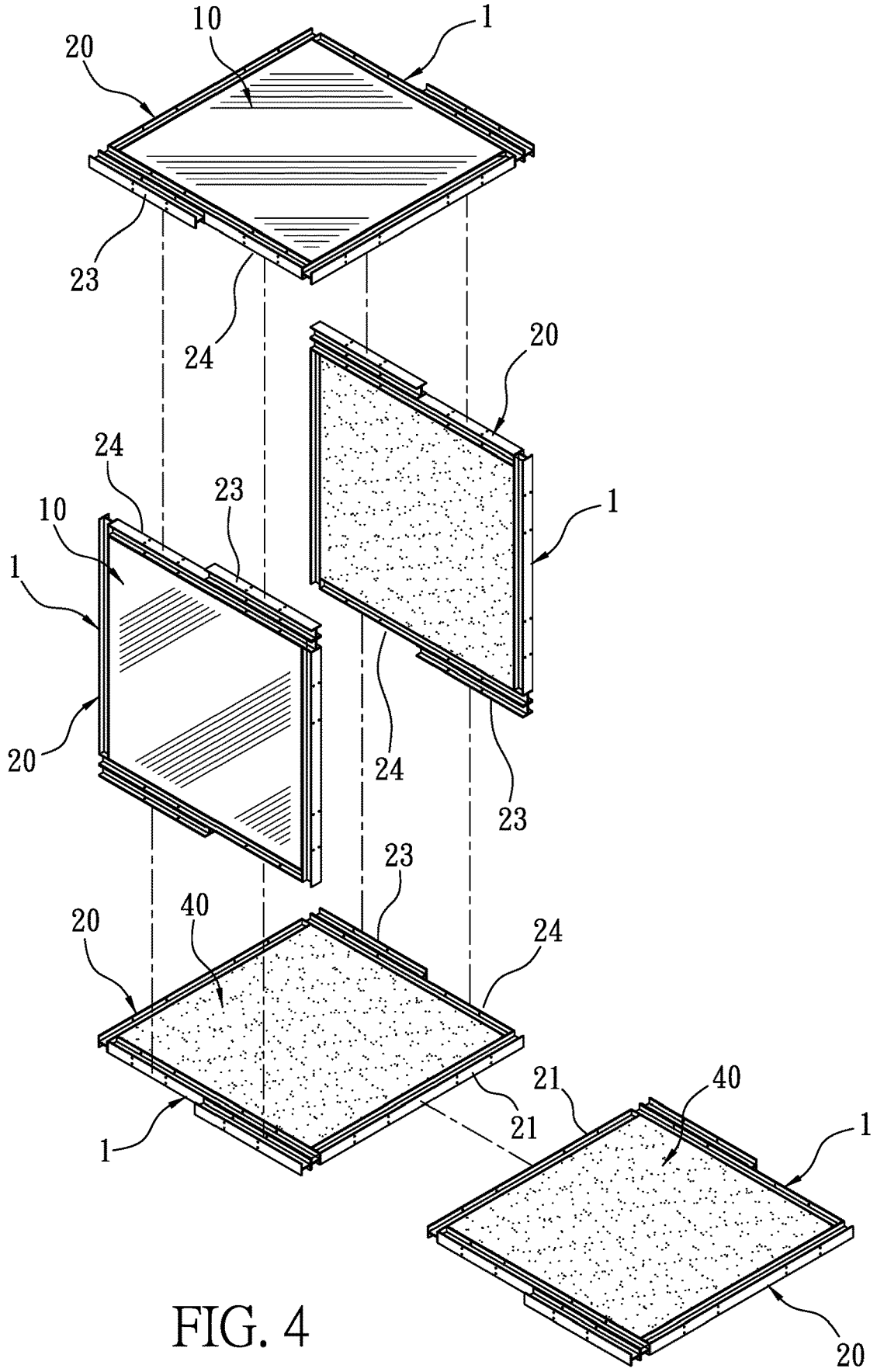
FIG. 4 is a perspective view showing the operation of the precast building material according to the preferred embodiment of the present invention.
Figure 5:
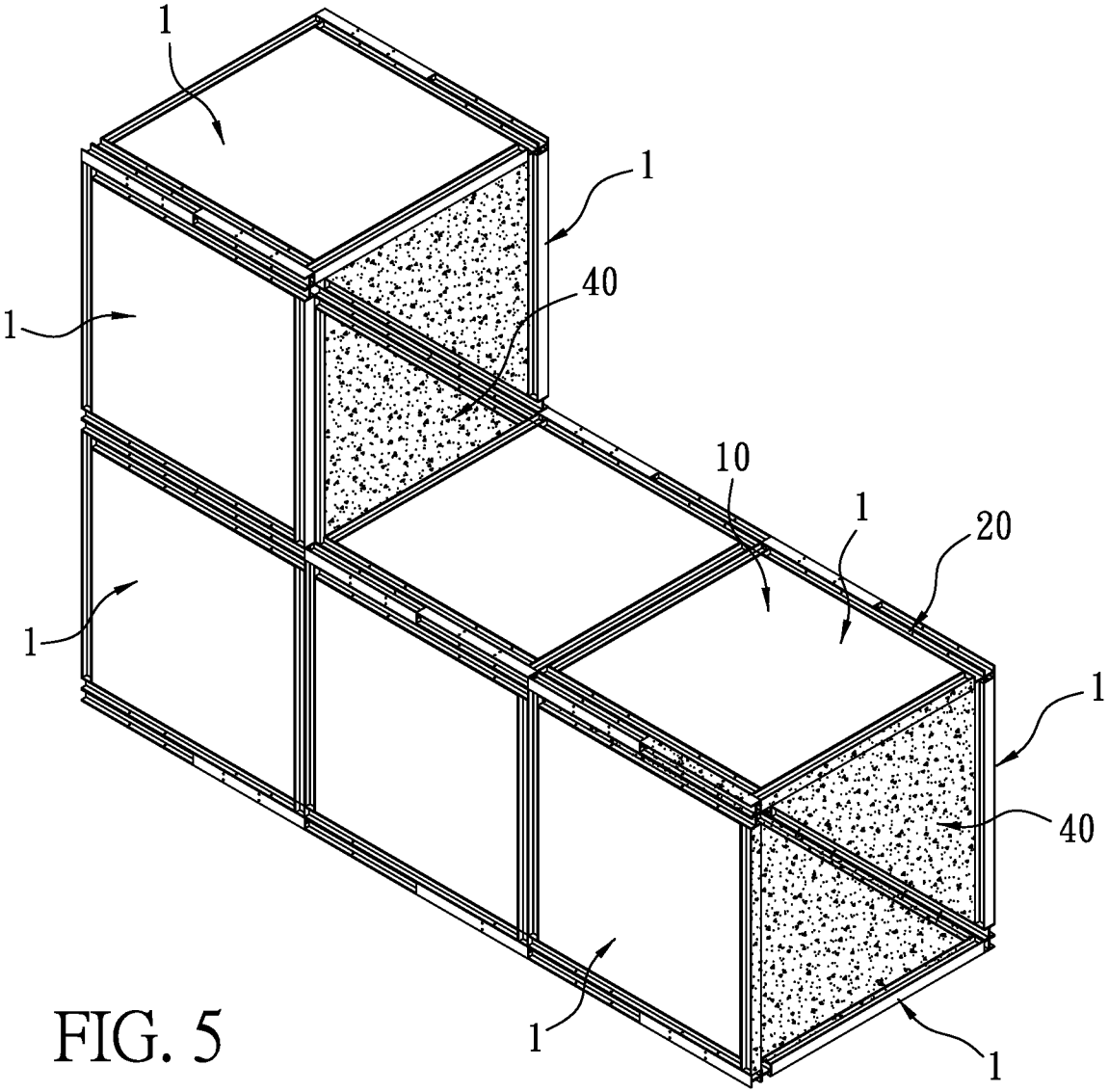
FIG. 5 is another perspective view showing the operation of the precast building material according to the preferred embodiment of the present invention.
Figure 6:
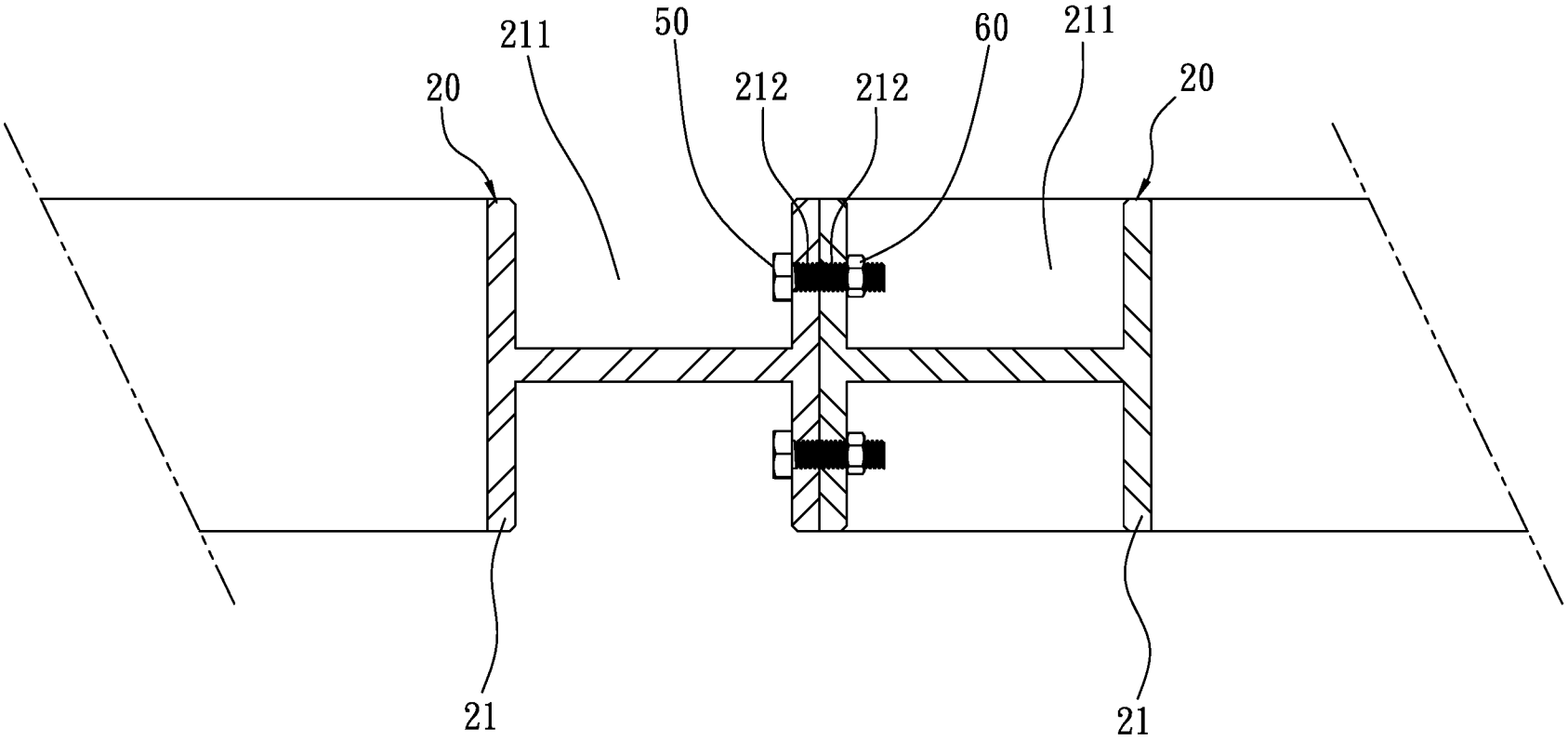
FIG. 6 is a cross-sectional view showing the operation of the precast building material according to the preferred embodiment of the present invention.
Figure 7:
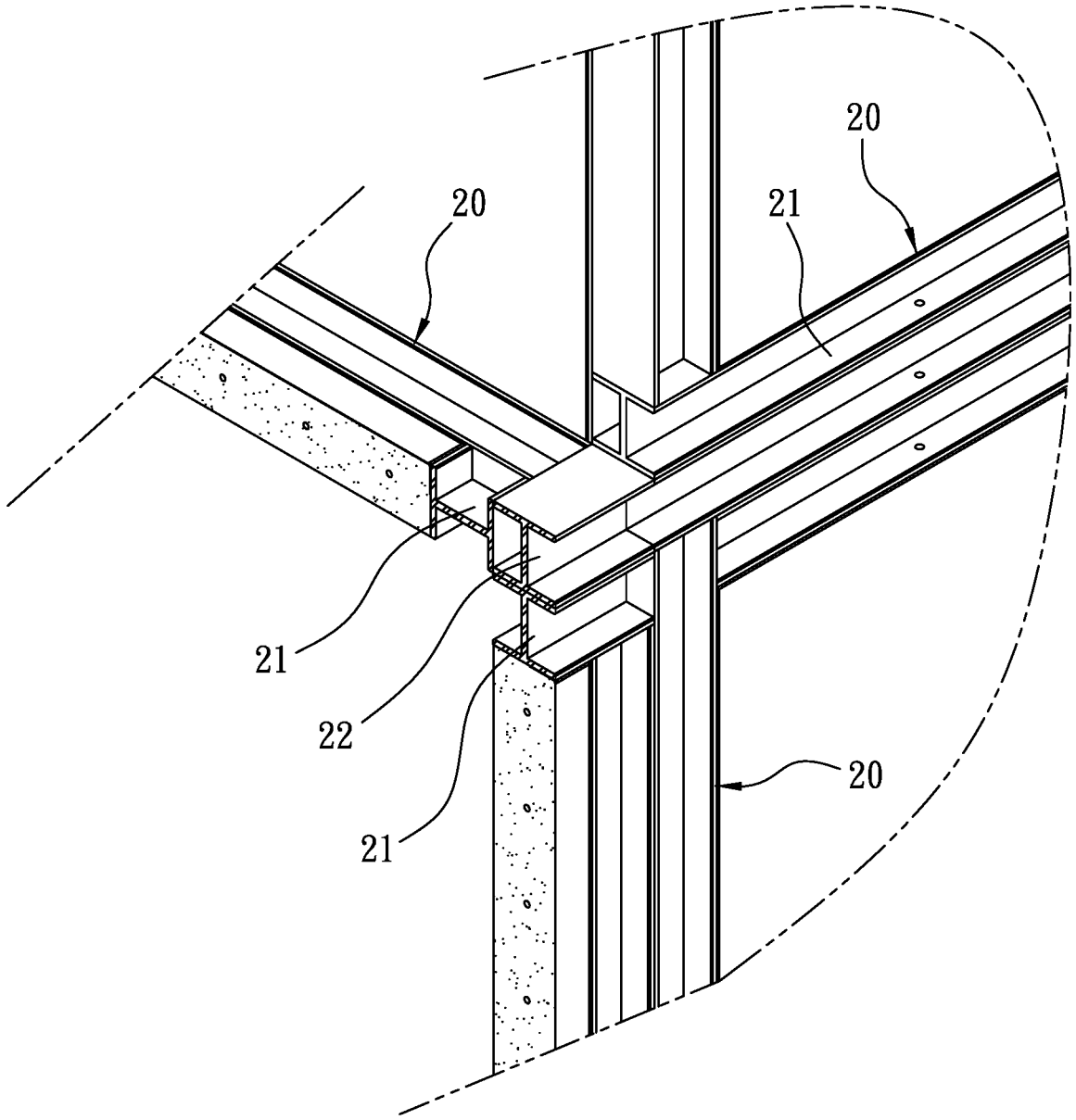
FIG. 7 is a cross-sectional perspective view showing the operation of the precast building material according to the preferred embodiment of the present invention.
Figure 8:
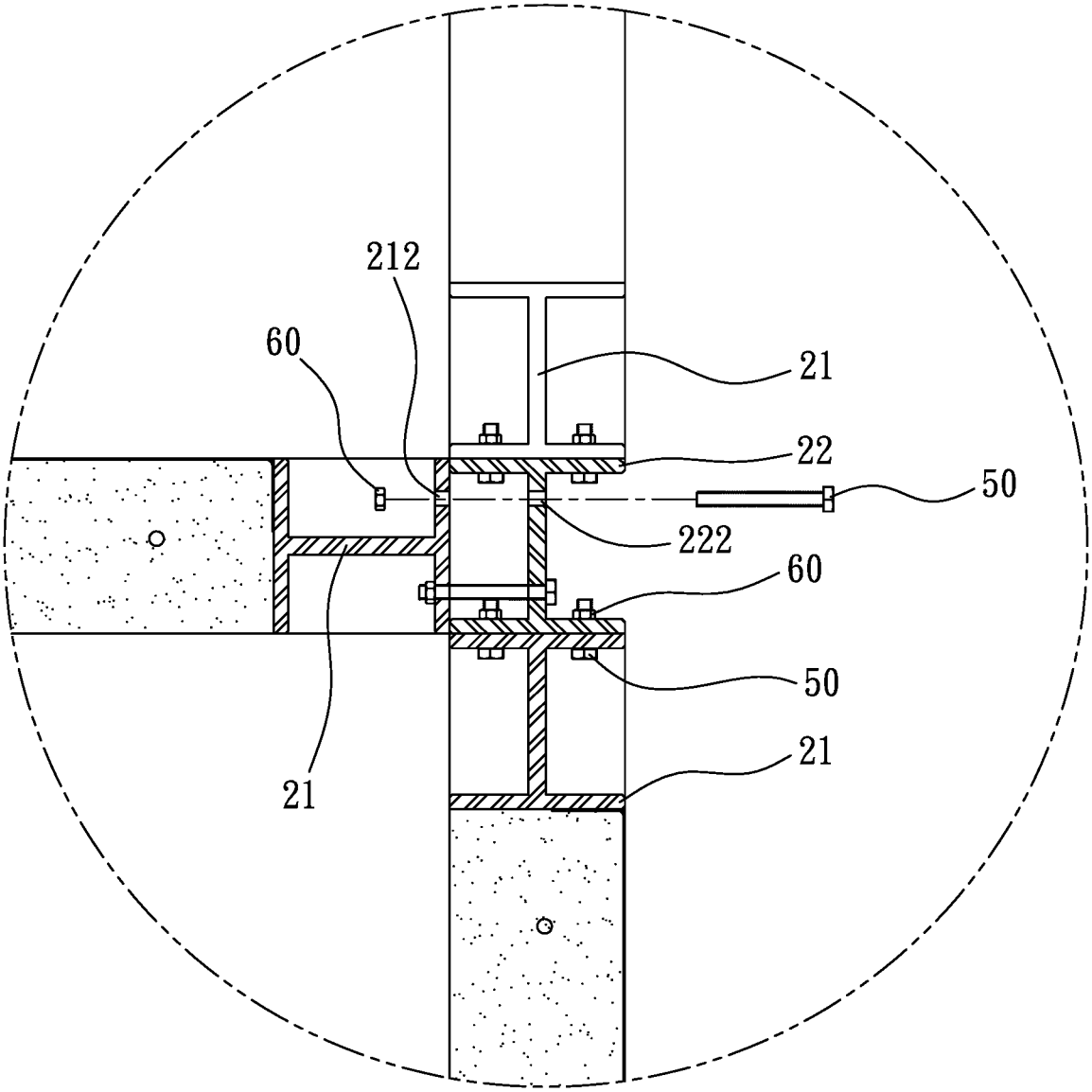
FIG. 8 is another cross-sectional view showing the operation of the precast building material according to the preferred embodiment of the present invention.

With reference to FIGS. 1-3, a precast building material 1 according to a preferred embodiment of the present invention comprises: a substrate 10, a peripheral frame 20, a metal reinforcement unit 30, and a concrete layer 40.

The substrate 10 is formed in a parallelogram shape and is detachable, wherein the substrate 10 is made of metal, for example, the substrate 10 is formed in a rectangle shape and is made of steel or plastic aluminum.

The peripheral frame 20 is mounted around a peripheral side of the substrate 10 so that an accommodation chamber A0 is defined between the peripheral frame 20 and the substrate 10, wherein the peripheral frame 20 includes multiple first connection rails 21, and a respective first connection rail 21 has at least one first slot 211 defined thereon, wherein at least two sides of the peripheral frame 20 are screwed with multiple second connection rails 22 by using multiple screw bolts 50 and multiple nuts 60, wherein the multiple second connection rails 22 are not opposite to each other, and a respective second rail 22 has at least one second slot 221 defined thereon, and the peripheral frame 20 includes multiple first engagement portions 23 fixed on the at least two sides thereof and multiple second engagement portions 24, wherein a respective second engagement portion 24 mates with a respective first engagement portion 23. The respective first connection rail 21 has multiple first locking orifices 212 defined thereon, and the respective second connection rail 22 has multiple second locking orifices 222 formed thereon. In this embodiment, two opposite sides of the peripheral frame 20 and two second connection rails 22 are parallelly connected to the substrate 10 by ways of the multiple screw bolts 50 and the multiple nuts 60, and two first engagement portions 23 and two second engagement portions 24 are engaged with one another and are fixed with the two opposite sides of the peripheral frame 20 parallel to the substrate 10 respectively, wherein a cross section of a connection of the respective first engagement portion 23 and the respective second engagement portion 24 is in an H shape, a U shape or other shapes.

The metal reinforcement unit 30 is accommodated in the accommodation chamber A0 and is welded with an inner wall of the accommodation chamber A0, wherein the metal reinforcement unit 30 includes multiple rebars 31, and the multiple rebars 31 are intersected with one another.

The concrete layer 40 is made of a mixture of cements, sands, stones, and waters and paves the accommodation chamber A0 to cover the metal reinforcement unit 30, such that the concrete layer 40 is connected with the peripheral frame 20 and the metal reinforcement unit 30 and is removable from the substrate 10.

As shown in FIGS. 3 to 8, when building a house by using multiple precast building materials 1, the multiple precast building materials 1 are connected so that multiple peripheral frames 20 of the multiple precast building materials 1 contact with one another, and the multiple screws 50 are inserted through the multiple first locking orifices 212 of the multiple first connection rails 21 of the multiple precast building materials 1 to screw with the multiple nuts 60, hence the multiple precast building materials 1 are connected parallelly. Then, the multiple first engagement portions 23 and the multiple second engagement portions 24 of the multiple precast building materials 1 are connected vertically or horizontally, wherein the multiple first engagement portions 23 are engaged with the multiple second engagement portions 24, and the multiple screw bolts 50 are inserted through the multiple first locking orifices 212 of the multiple first connection rails 21 and the multiple second locking orifices 222 of the multiple second connection rails 22 to screw with the multiple nuts 60 respectively so that the multiple precast building materials 1 are connected vertically or horizontally, thus building the house. Preferably, the at least one first slot 211 of the respective first connection rail 21 and the at least one second slot 221 of the respective second connection rail 22 are configured to accommodate various pipes, cables, and wires.

Figure 9:
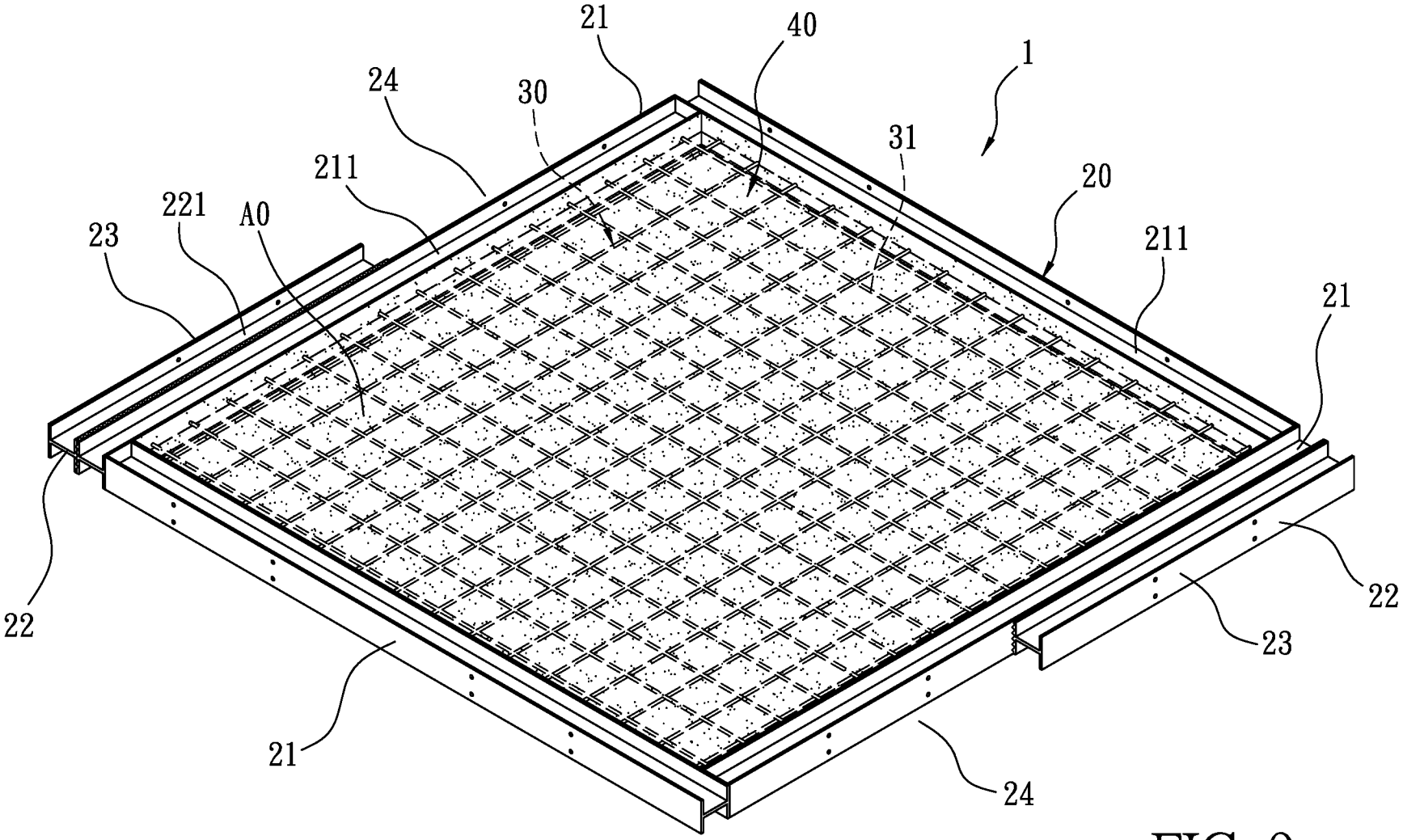
FIG. 9 is a perspective view showing the assembly of a precast building material according to another preferred embodiment of the present invention.
Figure 10:
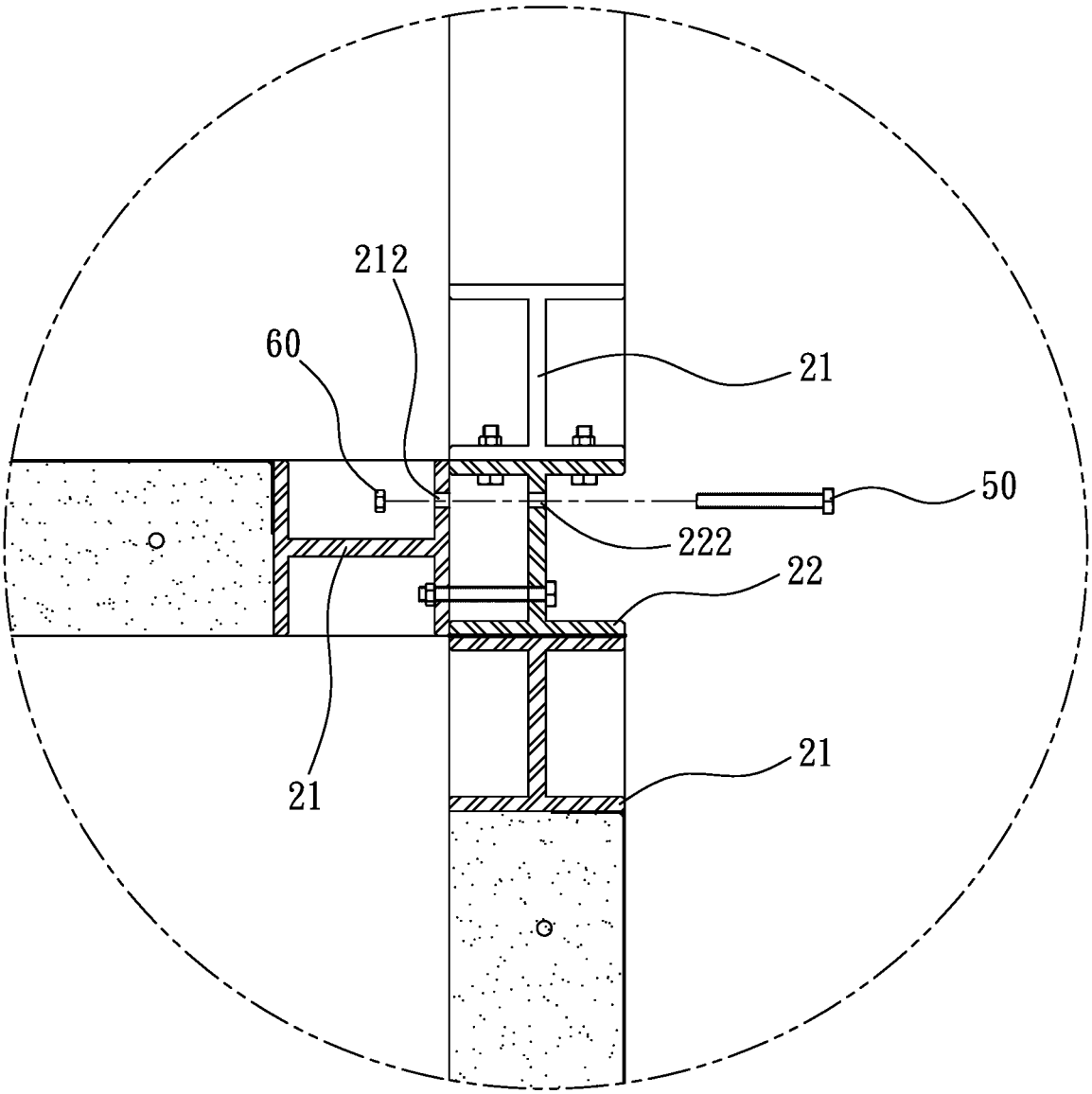
FIG. 10 is a cross-sectional view showing the operation of the precast building material according to the preferred embodiment of the present invention.

In another embodiment, as illustrated in FIGS. 9 and 10, the multiple second connection rails 22 are welded on two opposite sides of the peripheral frame 20, wherein the multiple second connection rails 22 are not opposite to each other.

Figure 11:
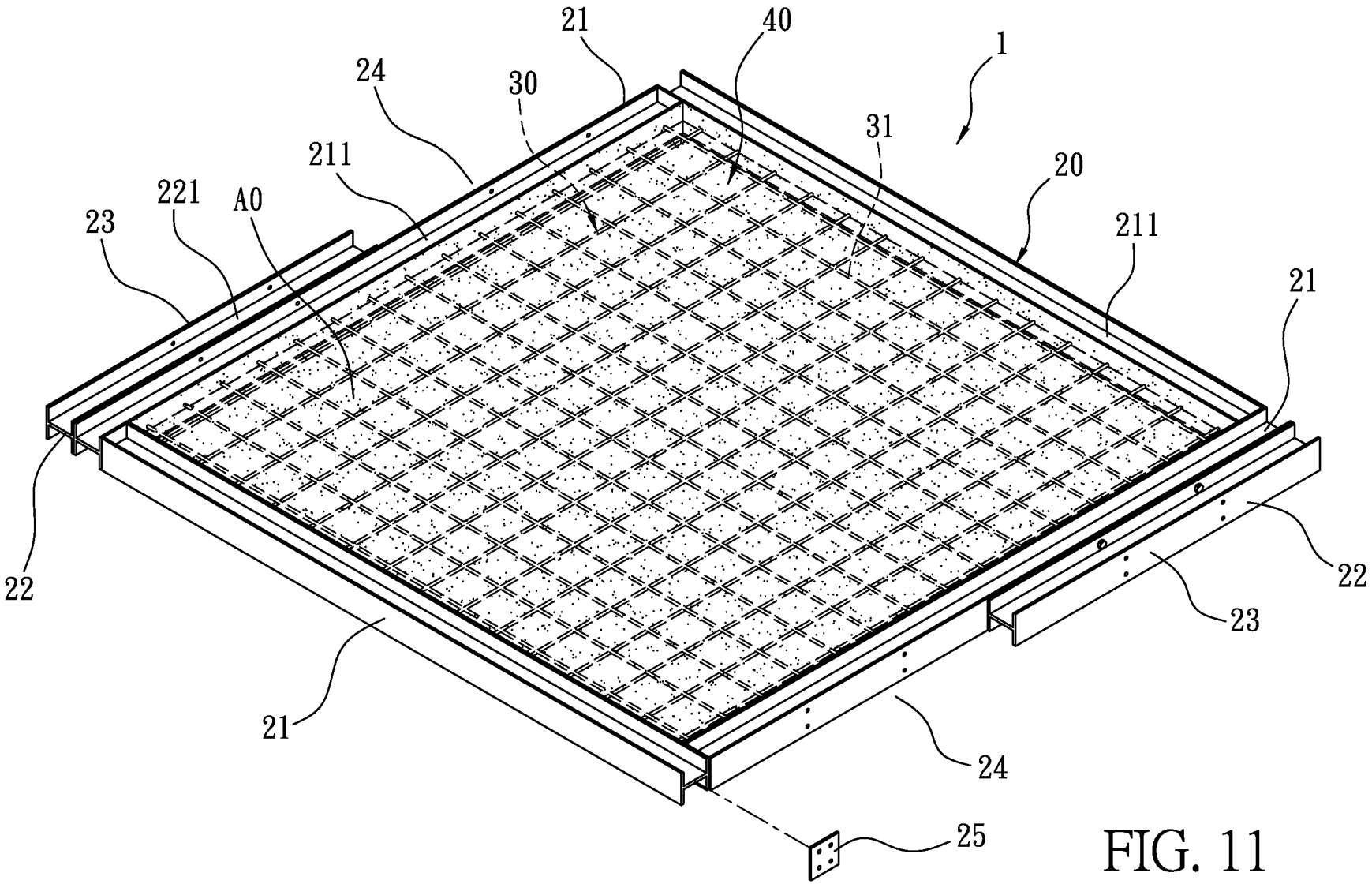
FIG. 11 is a perspective view showing the exploded components of a precast building material according to another preferred embodiment of the present invention.
Figure 12:
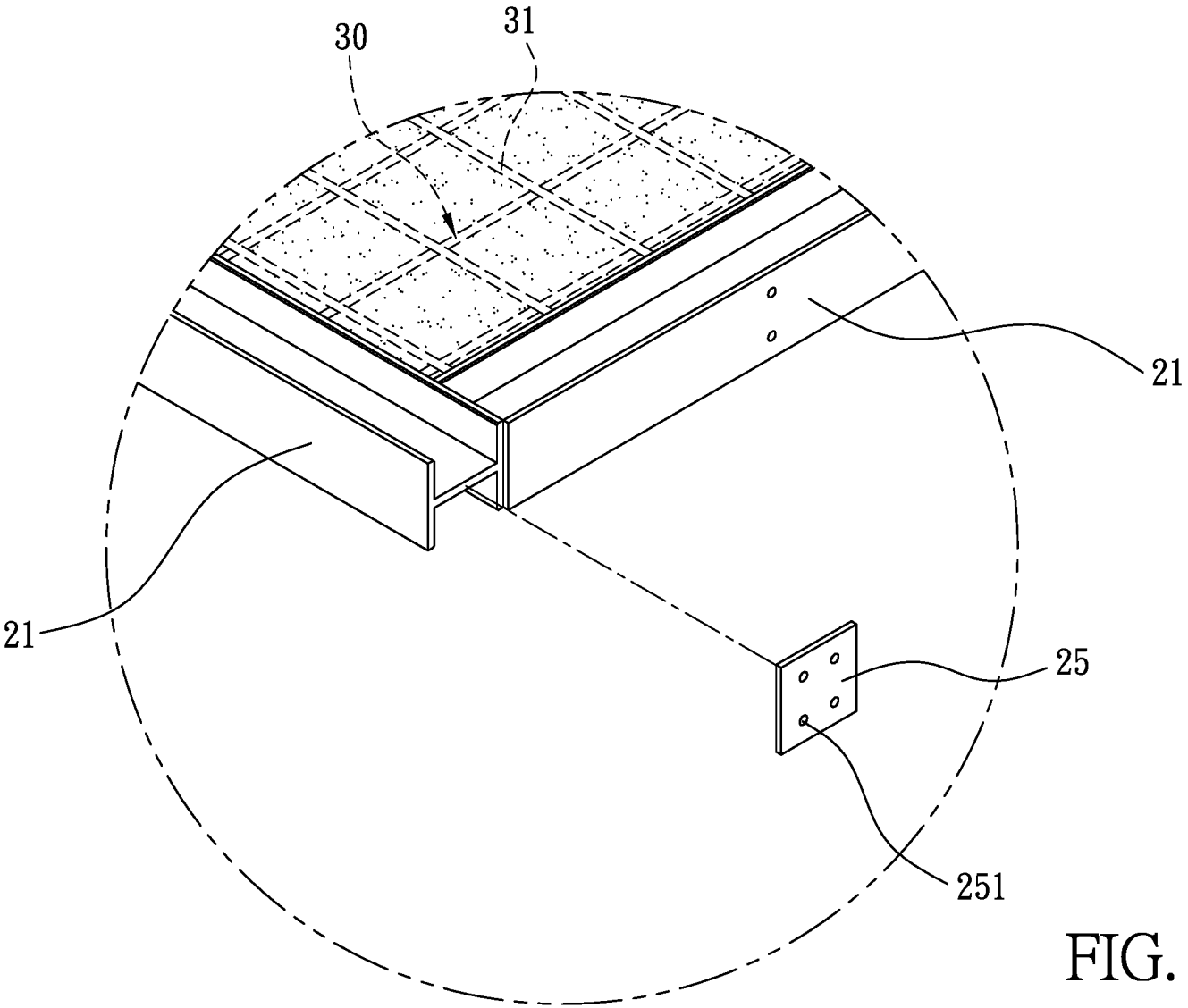
FIG. 12 is an amplified perspective view of a part of FIG. 11.
Figure 13:
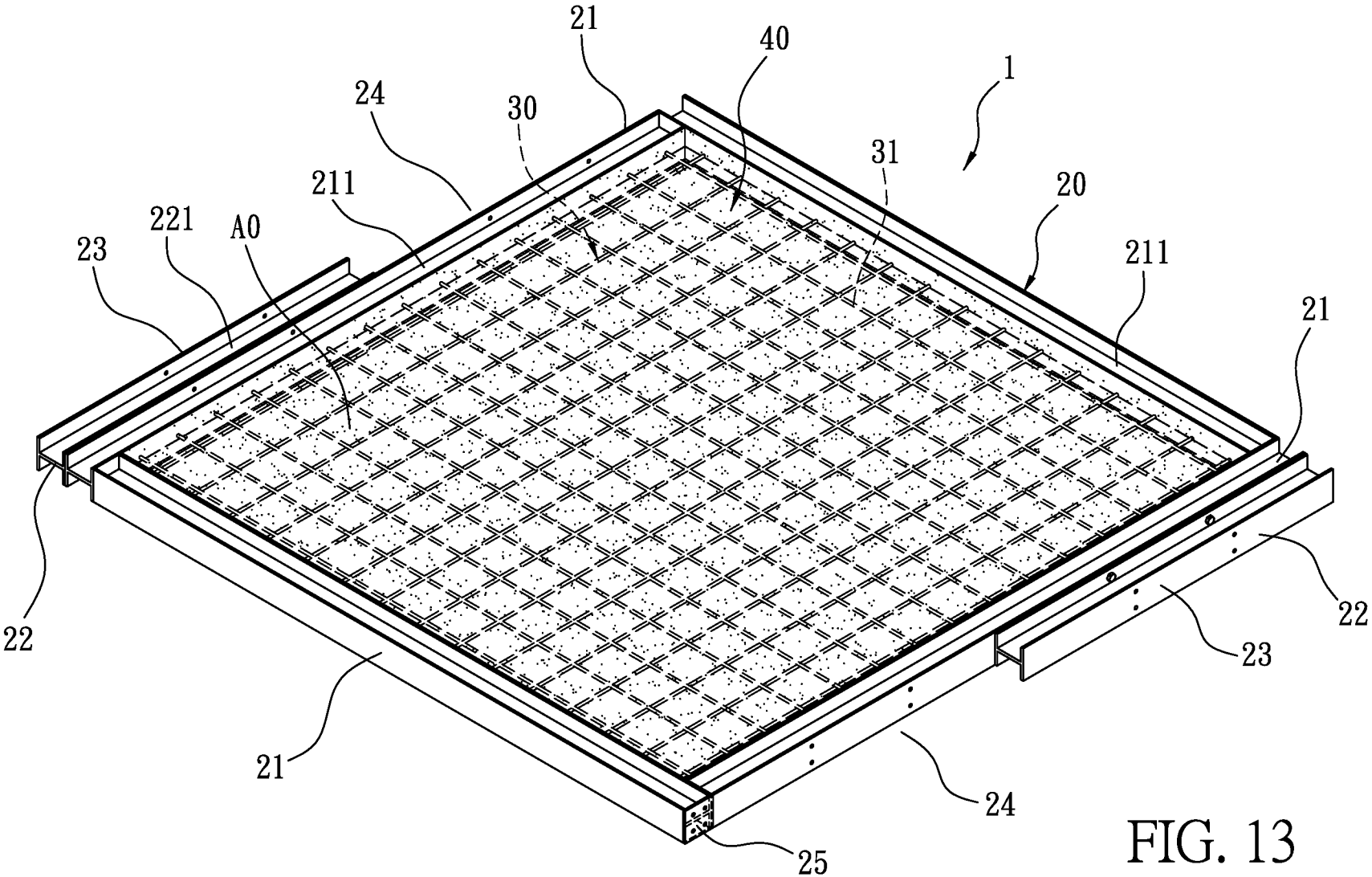
FIG. 13 is a perspective view showing the assembly of a precast building material according to another preferred embodiment of the present invention.

Referring to FIGS. 11-13, a cap 25 is fixed on an edge of the respective first connection rail 21 of the peripheral frame 20, and the cap 25 has at least one locating aperture 251 to connect with the other precast building material 1.

Figure 14:
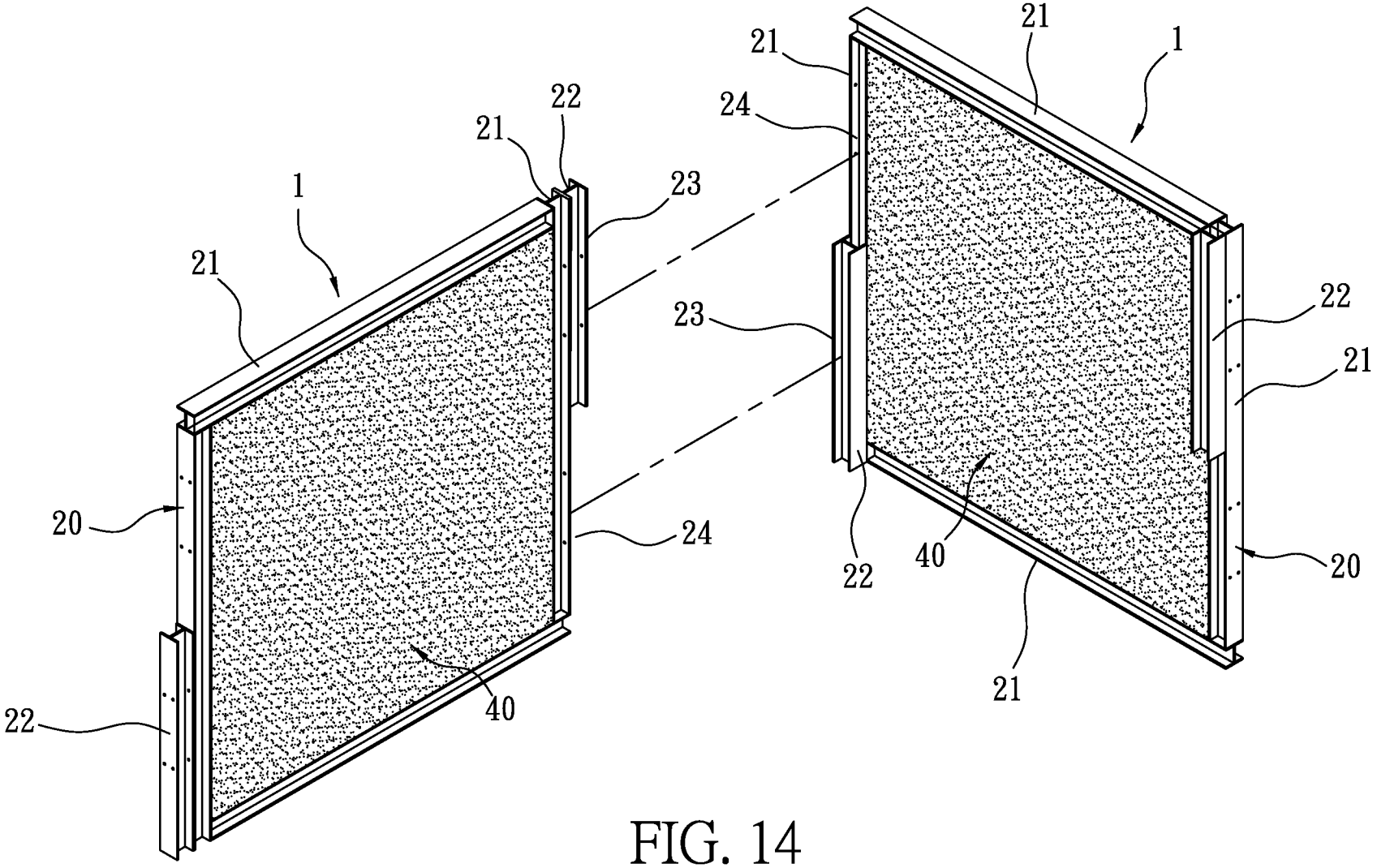
FIG. 14 is a perspective view showing the operation of a precast building material according to another preferred embodiment of the present invention.

With reference to FIG. 14, in another embodiment, two substrates 10 are perpendicularly connected, wherein two peripheral frames 20 are connected to the substrates 10 respectively by ways of the multiple screw bolts 50 and the multiple nuts 60, a second connection rail 22 of a side of one peripheral frame 20 is connected with a second connection rail 22 of an end of the other peripheral frame 20 vertically, and a first engagement portion 23 of the second connection rail 22 of the side of the one peripheral frame 20 is engaged with a second engagement portion 24 of the second connection rail 22 of the end of the other peripheral frame 20 vertically.

Figure 15:
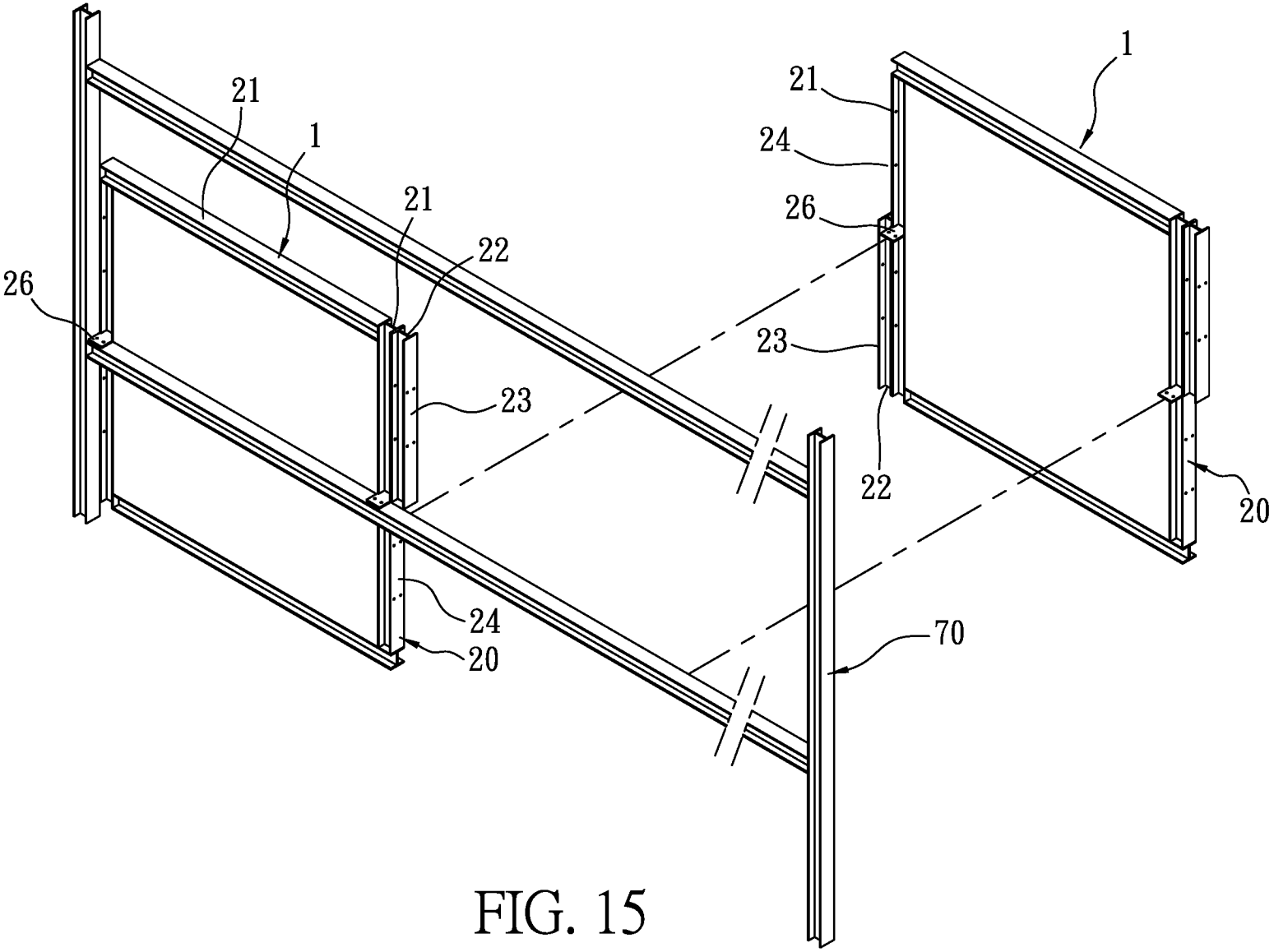
FIG. 15 is a perspective view showing the operation of a precast building material according to another preferred embodiment of the present invention.
Figure 16:
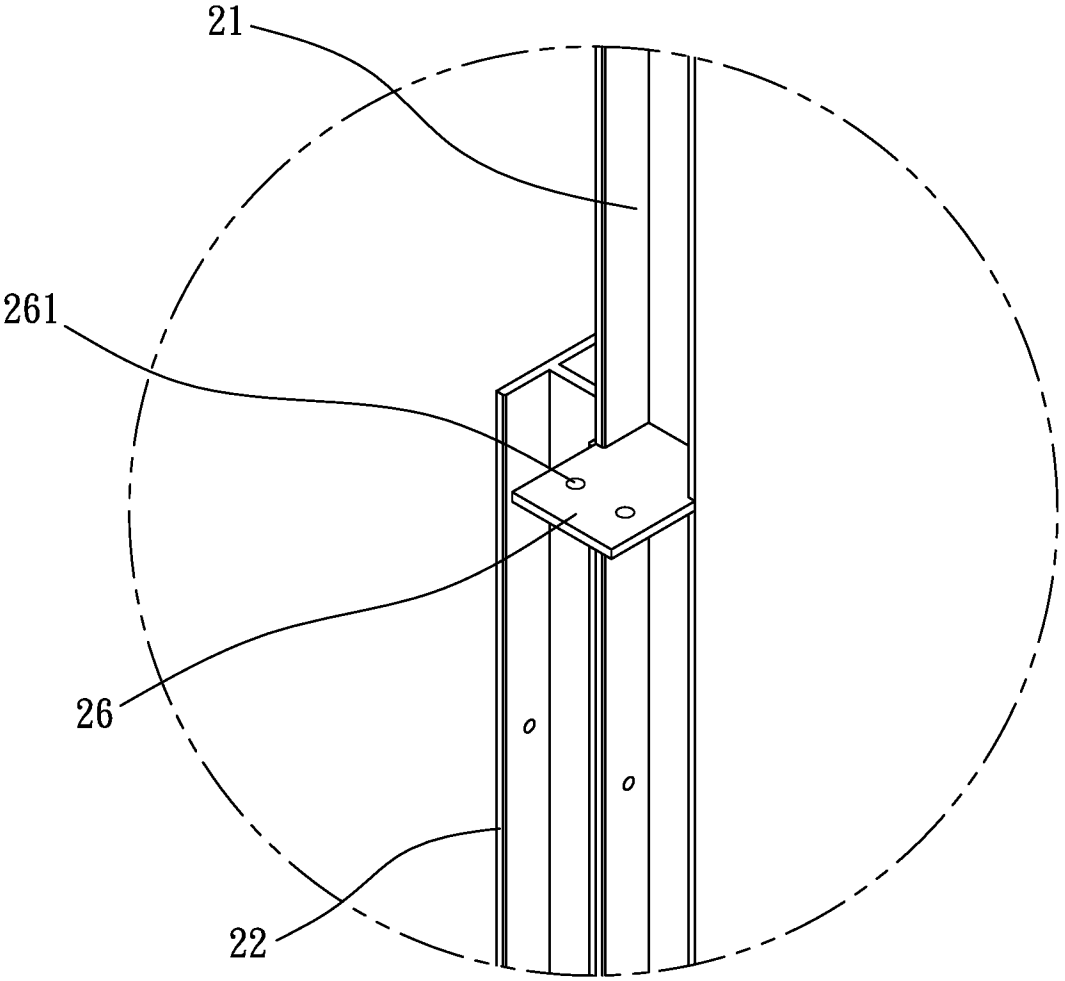
FIG. 16 is an amplified perspective view of a part of FIG. 15.

With reference to FIGS. 15 and 16, in another embodiment, respective first connection rail 21 of a respective peripheral frame 20 has a coupling sheet 26 extending outward therefrom, and the coupling sheet 26 has at least one securing hole 261 defined thereon and configured to connect the coupling sheet 26 on a support rack 70, thus fixing the respective precast building material 1 on the support rack 70.

Therefore, the precast building material of the present invention has advantages as follows:

1. The precast building material 1 is pre-casting formed in a factory and is moved to a construction site so as to build the house easily at a low construction cost, thus accelerating construction time, applying for various houses, and recycling the precast building material.

2. The precast building material 1 reinforces the house and facilitates security, fire and heat resistance, noise isolation, and seismic performance.

While various embodiments in accordance with the present invention have been shown and described, it is clear to those skilled in the art that further embodiments may be made without departing from the scope of the present invention.

What is claimed is:

1. A precast building material comprising:

a substrate formed in a parallelogram shape;

a peripheral frame mounted around a peripheral side of the substrate so that an accommodation chamber is defined between the peripheral frame and the substrate, wherein the peripheral frame includes multiple first connection rails, and a respective first connection rail has at least one first slot defined thereon, wherein at least two sides of the peripheral frame are screwed with multiple second connection rails, and a respective second rail has at least one second slot defined thereon, the peripheral frame includes multiple first engagement portions fixed on the at least two sides thereof and multiple second engagement portions, wherein a respective second engagement portion mates with a respective first engagement portion, the respective first connection rail has multiple first locking orifices defined thereon, and the respective second connection rail has multiple second locking orifices formed thereon;

a metal reinforcement unit accommodated in the accommodation chamber and welded with an inner wall of the accommodation chamber, wherein the metal reinforcement unit includes multiple rebars, and the multiple rebars are intersected with one another; and a concrete layer paving the accommodation chamber to cover the metal reinforcement unit, such that the concrete layer is connected with the peripheral frame and the metal reinforcement unit and is removable from the substrate.

2. The precast building material as claimed in claim 1, wherein a cross section of a connection of the respective first engagement portion and the respective first engagement portion is in an H shape.

3. The precast building material as claimed in claim 1, wherein a cap is fixed on an edge of the respective first connection rail of the peripheral frame, and the cap has at least one locating aperture.

4. The precast building material as claimed in claim 1, wherein the respective first connection rail has a coupling sheet extending outward therefrom, and the coupling sheet has at least one securing hole defined thereon.

* * * * *